US005829164A

United States Patent [19]

Kotitschke

[11] Patent Number: 5,829,164

[45] Date of Patent: Nov. 3, 1998

[54] METHOD AND MACHINE FOR DRYING A MATERIAL WEB WITH GUIDE ROLLERS

[75] Inventor: Gerhard Kotitschke, Steinheim, Germany

[73] Assignee: Voith Sulzer Papiermaschinen GmbH, Heidenheim, Germany

[21] Appl. No.: 834,333

[22] Filed: Apr. 16, 1997

[30] Foreign Application Priority Data

Apr. 18, 1996 [DE] Germany ..... 196 15 227.5

[51] Int. Cl.[6] ..... D21F 5/00

[52] U.S. Cl. ..... 34/453; 34/115; 34/122; 34/456; 34/458

[58] Field of Search ..... 34/452, 453, 456, 34/458, 114, 115, 122

[56] References Cited

U.S. PATENT DOCUMENTS

| | | | |
|---|---|---|---|
| 5,022,163 | 6/1991 | Ilvespää et al. | 34/115 X |
| 5,135,614 | 8/1992 | Aula et al. . | |
| 5,241,760 | 9/1993 | Wedel | 34/115 X |
| 5,465,502 | 11/1995 | Holik et al. | 34/115 |

FOREIGN PATENT DOCUMENTS

| | | |
|---|---|---|
| 0432571 | 6/1991 | European Pat. Off. . |
| 3910600 | 10/1990 | Germany . |
| 94/03675 | 2/1994 | WIPO . |

OTHER PUBLICATIONS

Copy of a European Search Report dated Feb. 25, 1998.

*Primary Examiner*—Henry A. Bennett
*Assistant Examiner*—Steve Gravini
*Attorney, Agent, or Firm*—Greenblum & Bernstein P.L.C.

[57] ABSTRACT

A machine for producing a material web, e.g., a paper or cardboard web, with a dryer section including at least one dryer group having a plurality of dryer cylinders and a plurality of web guide rolls, e.g., suction web guide rolls. At least one web guide roll, and preferably all, may be associated with an external suction box. Further, a jacket of the at least one web guide roll may include a plurality of through openings and at least one groove formed in an outer surface of the jacket. A predetermined number, and preferably all, of the through openings may be coupled with a bottom portion of the at least one groove to enable the external suction box to suction the at least one web guide roll.

30 Claims, 1 Drawing Sheet

METHOD AND MACHINE FOR DRYING A MATERIAL WEB WITH GUIDE ROLLERS

CROSS-REFERENCE OF RELATED APPLICATION

The present invention claims the priority under 35 U.S.C. §119 of German Patent Application No. 196 15 227.5 filed on Apr. 18, 1996.

BACKGROUND OF THE INVENTION

1. Field of the Invention

The present invention relates to a machine for producing a material web, e.g., a paper or cardboard web, with a dryer section including at least one dryer group having a plurality of dryer cylinders and suction web guide rolls. The machine may also include at least one web guide roll, associated with an external suction box, having a jacket with a plurality of openings which may feed into at least one groove formed into an outer circumferential face of the jacket.

The present invention may also relate to a process for producing a material web, e.g., a paper or cardboard web, in a web producing machine. The process may include forming at least one groove in an outer jacket of a suction web guide roll, coupling through openings within the at least one formed groove, and associating an external suction box with the suction web guide roll.

2. Discussion of Background Information

Machines and processes similar to the type generally discussed above are known in the prior art. These prior art systems generally include a dryer section having at least one dryer group. The at least one dryer group has a number of dryer cylinders and suction web guide rolls around which a material web is guided, in a meandering or winding path, with the aid of a transport or dryer belt. Frequently in the prior art systems, delivering a vacuum to the web guide rolls is expensive because a vacuum line is located in a region of a carrier shaft of the web guide rolls. Thus, the embodiment of the bearing regions becomes relatively costly. In many instances, custom designs are necessary to be able to compensate for a length extension of the web guide rolls.

SUMMARY OF THE INVENTION

An object of the present invention is to produce a machine and a process for producing a material web which do not suffer the same or similar disadvantages to those discussed above.

To attain this object, the web producing machine may include a dryer section having at least one dryer group with a plurality of dryer cylinders and a plurality of suction web guide rolls. The machine may also include at least one web guide roll, preferably all of the web guide rolls, associated with an external suction box. The at least one web guide roll may include a jacket having a plurality of openings through the jacket, in which at least one of the plurality of openings may feed into at least one groove formed in an outer circumferential face of the jacket. Because the present invention utilizes an external suction box, the bearing of the suction web guide roll may be simplified to a large degree. This arrangement, therefore, subjects the web guide roll to a vacuum from the outside. As noted above, the jacket may be provided with a plurality of through openings, the openings utilized by the external suction box to create a vacuum within the web guide roll. The vacuum created or built up within the web guide roll may be exerted on an outside of the web guide roll located opposite the suction box through the openings. Thus, the material web being guided (or running around) the web guide roll may be held or stabilized by the vacuum created within the guide roll.

In an exemplary embodiment of the machine of the present invention, the at least one web guide roll may include at least one groove formed within an outer circumference of the roll jacket. Each of the grooves may be located on a continuous closed circular line. Circular line may be understood to mean a line situated within an imaginary plane and located perpendicular to a central or rotational axis of the web guide roll.

In another exemplary embodiment of the machine, the groove may run or be formed to extend along an imaginary helix along an outer circumference of the web guide roll. The groove may be formed into an outer surface of the web guide roll, e.g., in a work cycle.

In another exemplary embodiment of the present invention, the grooves formed within the outer circumference of the guide roll may be continuous. On a surface of the web guide roll, i.e., remote from location of the suction box, the grooves may be covered by the dryer belt so that the pressure prevailing within the web guide roll may build up in the groove. In accordance with the present invention, it may be ensured that the vacuum force may reach larger regions of the material web, thus, holding forces exerted on a particularly large area.

Finally, in another exemplary embodiment of the machine, the total area of the grooves may be significantly greater than a total cross sectional area of the through openings fed into the grooves. Therefore, the jacket of the web guide roll may be weakened by a relatively small number of through openings. Nevertheless, a relatively large area may be acted upon with the vacuum, e.g., the effective external area of the grooves. The vacuum built up in the grooves may act on the area of the web guide roll that is covered up by the dryer belt and/or the material web. In this instance, a virtual projection of the groove surface onto an imaginary external jacket face of the web guide roll may be contemplated.

The object may also be attained by a process for producing a material web, e.g., a paper or cardboard web, in a web producing machine. The process may include forming at least one groove into an outer circumference of a web guide roll, coupling through openings to the at least one groove, and associating an external suction box with the web guide roll. At least one groove may be formed in the jacket of a suction web guide roll from the outside, and through openings may be bored into the groove and extend, e.g., in a radial direction. The web guide roll may be associated with an external suction box, e.g., positioned adjacent the web guide roll and oriented toward the web guide roll to create and build up a vacuum within the web guide roll through the through openings. The vacuum may be transmitted to the outer jacket face of the web guide roll via the through openings located opposite the suction box so that a material web running being guided around the web guide roll may be is stabilized and secured there.

In another exemplary embodiment of the process of the present invention, the through openings and the groove or grooves may be formed into the jacket of a web guide roll already installed in a machine for producing a material web. Accordingly, it is not necessary to remove the web guide roll from the machine in order to couple the through openings into the jacket of the web guide roll from a bottom of the at least one groove to the inside of the web guide roll. Further, the vacuum may be created or built up within the web guide roll by the external suction box through the through openings. Because the vacuum may be built up within the web guide roll by the through openings in a groove having a surface viewed as an effective area for the material web being guided around the web guide roll, a relatively small number of through openings may be utilized to build up adequately great, i.e., sufficient, vacuum on an outside of the web guide roll. Because a relatively small number of through openings may be required, a time expenditure for forming the through openings may be significantly reduced. In addition, an unnecessary. weakening of the jacket of the web guide roll is prevented.

The present invention may be directed to a machine for producing a material web. The machine may include a dryer section including at least one dryer group having a plurality of dryer cylinders and a plurality of web guide rolls. At least one of the plurality of web guide rolls may be associated with an external suction box and may include a jacket. The jacket may include a plurality of through openings and at least one groove formed in an outer surface of the jacket and a predetermined number of the plurality of through openings may be coupled to the at least one groove.

According to another feature of the present invention, the at least one groove may include a plurality of grooves located over a width of the jacket.

According to another feature of the present invention, each of the plurality of grooves may be arranged on a closed circular line.

According to still another feature of the present invention, the plurality of grooves may be equally spaced from each other.

According to a further feature of the present invention, the at least one groove may extends in the form of a helix.

According to a still further feature of the present invention, the at least one groove may be continuous.

According to still another feature of the present invention, a total area of the at least one groove may be substantially greater than a total cross sectional area of the predetermined number of through openings.

The present invention may be directed to a process for producing a material web in a web producing machine. The web producing machine may include a dryer section including at least one dryer group having a plurality of dryer cylinders and a plurality of web guide rolls, at least one of the plurality of web guide rolls associated with an external suction box and including a jacket having a plurality of through openings and at least one groove formed in an outer surface of the jacket. The process may include forming at least one groove in an outer surface of the jacket of the web guide roll, forming through openings in the at least one groove, and associating an external suction box with the at least one web guide roll.

According to another feature of the present invention, the process may further include forming a plurality of grooves in the outer surface of the jacket, distributing each of the plurality of formed grooves over a width of the jacket, and arranging each of the plurality of formed grooves on a closed circular line.

According to still another feature of the present invention, the process may further include equally spacing each of the formed plurality of grooves.

According to a further feature of the present invention, the process further comprising forming the at least one groove as a helix extending along the jacket.

According to another feature of the present invention, the process may further include forming the at least one groove as at least one continuous groove.

According to yet another feature of the present invention, the process may further include forming the through openings and the at least one groove in the jacket while the at least one web guide roll is mounted in the machine.

The present invention may be directed to a suction web guide roll positioned in a dryer section of a material web producing machine. The suction web guide roll may include an elongated hollow jacket including a plurality of through holes and at least one groove formed in an outer surface of the jacket, the groove having a bottom surface such that a predetermined number of the plurality of the through holes may be coupled to the bottom surface.

According to another feature of the present invention, the plurality of through holes may include a plurality of substantially radial through holes.

According to still another feature of the present invention, the at least one groove may include a width greater than a diameter of each of the predetermined number of the through holes.

According to a further feature of the present invention, the at least one groove may include a plurality of circular grooves arranged substantially parallel to each other.

According to another feature of the present invention, the plurality of circular grooves may be arranged substantially perpendicular to a longitudinal axis of the web guide roll.

According to a still further feature of the present invention, the at least one groove may include a helical groove extending a length of the jacket.

According to yet another feature of the present invention, the plurality of through openings may also include through openings coupled to the outer surface of the jacket.

The present invention may be directed to a process for forming a suction web guide roll. The process may include forming at least one groove, having a bottom surface, in an outer surface of an elongated jacket and forming a plurality of through holes in the at least one groove.

According to a further feature of the present invention, forming the plurality of through holes may include forming each of the plurality of through holes within the at least one groove such that a diameter for each through hole may be less than a width of the at least one groove.

According to another feature of the present invention, the process may further include positioning an external suction device adjacent a portion of the jacket to suction an interior portion of the suction web guide roll.

According to a still further feature of the present invention, forming the at least one groove may include forming a plurality of substantially parallel grooves in the outer surface of the jacket.

According to another feature of the present invention, forming the at least one groove may include forming a helical groove along a length of the jacket.

According to yet another feature of the present invention, the process may further include performing the process on a web guide roll, made of an air permeable material, seated in the machine.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the invention may be embodied in practice.

The present invention is discussed and explained in the context of a machine for producing a material web, e.g., a paper making machine. However, the present invention may be applicable in other similar type machines. The machine, in accordance with the present invention, may include a dryer section including at least one dryer group having a plurality of dryer cylinders and a plurality of web guide rolls. The produced material web may be guided by a transport or dryer belt or screen in a meandering or winding path around the dryer cylinders and web guide rolls.

Figure 1:
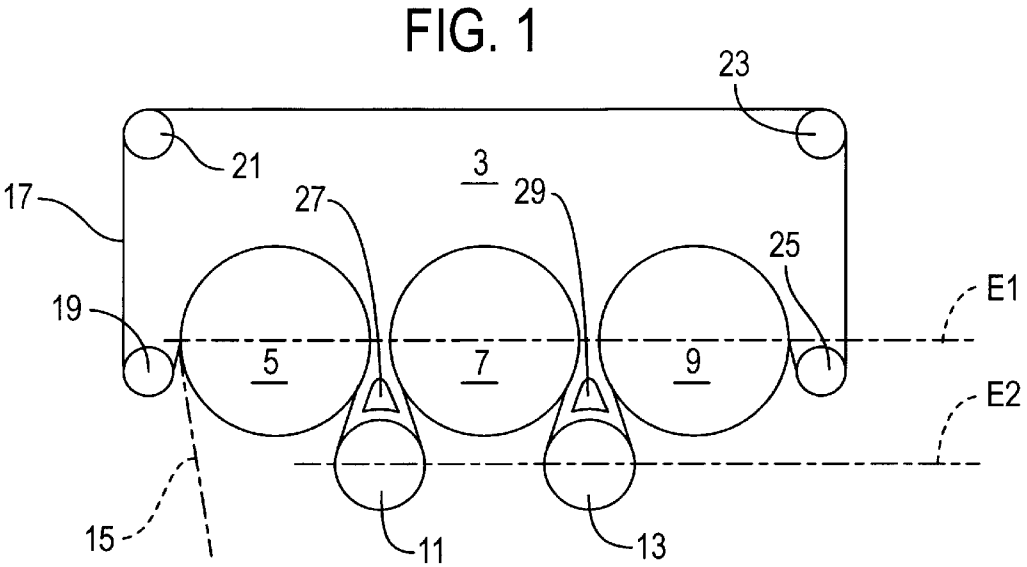
FIG. 1 illustrates a schematic view of a dryer group from a machine for producing a material web in accordance with the present invention.

FIG. 1 illustrates an exemplary dryer group 3 of a dryer section of a machine 1 for producing a continuous web, e.g., paper or cardboard. According to FIG. 1, dryer group 3 may include three dryer cylinders 5, 7, and 9, whose center points are disposed to form an imaginary first plane E1, and an intermediary space may be formed and maintained between each adjacent neighboring dryer cylinders. A material web 15, shown in dashed lines, may be guided around at least a portion of the dryer cylinders and at least a portion of the web guide rolls in a meandering or winding path by a transport belt (dryer screen) 17. When guided around the portions of the dryer cylinders, the material web may be directly in contact with an outer surface of the dryer cylinder on one side, and held in place by transport belt 17 on the other side. When guided around the portion of the web guide rolls, transport belt 17 may directly contact the web guide rolls and material web 15 may be guided around the web guide rolls on an outside of the transport belt 17. As is conventional in the art, transport belt 17 may be comprised of a closed loop that utilizes web guide rolls 25, 23, 21, and 19 to return transport belt 17 from an end of dryer group 3 to its beginning.

The center points of web guide rolls 11 and 13 may be located to form an imaginary second plane E2, which may be positioned spaced apart from plane E1. In the intermediary spaces between adjacent dryer cylinders and the associated web guide rolls, suction boxes 27 and 29, e.g., external suction boxes, may be positioned to aspirate web guide rolls 11 and 13, respectively.

Web guide rolls 11 and 13 may have an air permeable jacket to enable a vacuum to be created and built up inside web guide rolls 11 and 13 via the external suction boxes 27 and 29. Through the air permeable jacket, the vacuum created within the respective web guide rolls may act upon a region of the web guide roll that material web 15 is guided around by the transport web 17, which also may comprise an air permeable material. Therefore, a stabilization or fixing of material web 15 occurs along an outer circumference or surface of web guide rolls 11 and 13.

Figure 2:
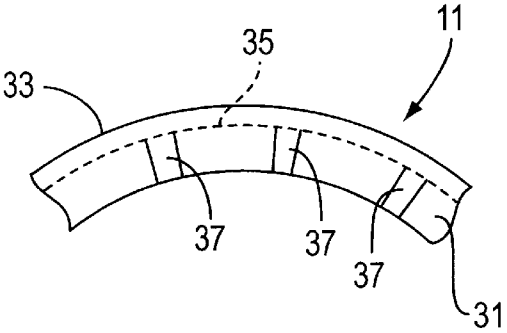
FIG. 2 illustrates a cross sectional view of a portion of a jacket of a web guide roll according to the present invention.

FIG. 2 illustrates a schematic view of a jacket 31 of web guide roll 11. It is noted that, web guide rolls 11 and 13 are preferably similarly constructed. A groove 35, a bottom portion of which may be represented with dashed lines, may be formed into the outer circumference or surface 33 of jacket 31. Further, through openings 37, which may penetrate through jacket 31 from an inside surface of jacket 31 to the bottom surface of groove 35. Therefore, while through openings 37 may pass completely through jacket 31, a depth of groove 35 may be formed as relatively shallow.

Figure 3:
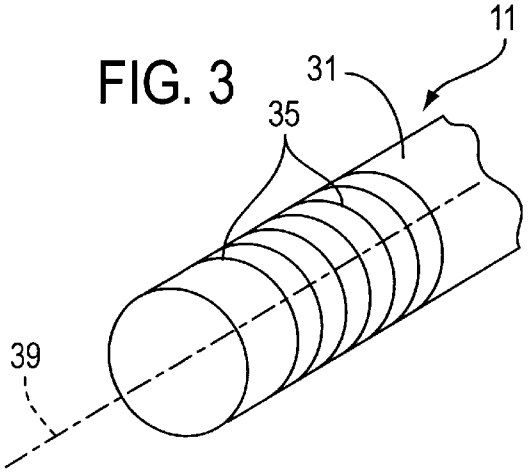
FIG. 3 illustrates a perspective top view of a jacket of a web guide roll having a exemplary groove form.

A perspective illustration of web guide roll 11, illustrated in FIG. 3, indicates that, in an exemplary arrangement, grooves 35 may be located adjacent to and spaced apart from each another. For example, grooves 35 may be located on circular lines which may be located in an imaginary plane substantially perpendicular to a rotational or central axis 39 of web guide roll 11.

Figure 4:
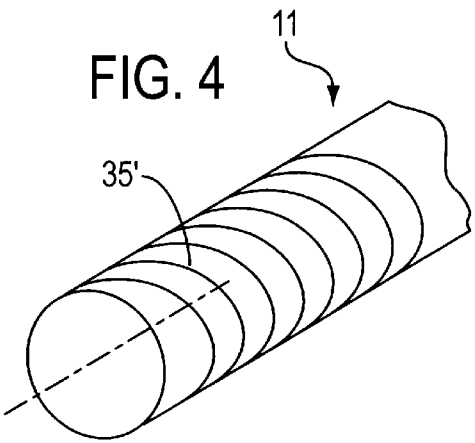
FIG. 4 illustrates a perspective top view of a jacket of a web guide roll having an alternative groove form.

FIG. 4 shows an alternative exemplary arrangement for groove 35. In this alternative arrangement, groove 35' may be located on an imaginary helix extending over a length of web guide roll 11. In either embodiment illustrated in FIGS. 3 and 4, groove 35 may be continuous. Alternatively, web guide rolls 11 and 13 may utilize groove sections, which may be located along a circular line or helical line, to be formed into an outer surface of jacket 31. The suction effect created by external suction boxes 27 and 29 may be increased by continuous grooves 35 or groove 35' formed in the outer surface of jacket 31. The vacuum exerted or created by suction box 27 or 29 may continue along grooves 35 and this vacuum action may extend to a region in which material web 15 abuts the outer circumference or surface 33.

Figure 5:
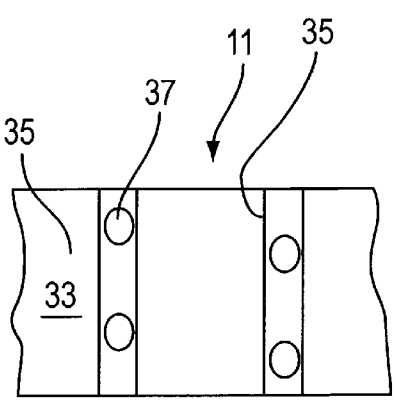
FIG. 5 illustrates a top view of a jacket of a web guide roll.

FIG. 5 illustrates a top view of a section of outer circumference or surface 33 of web guide roll 11. As depicted in the figure, a width of grooves 35 may be selected to be somewhat greater than a diameter of through openings 37. Thus, if grooves 35 are covered by transport belt 17 or by material web 15, a suction force may be determined by the vacuum according to an area of grooves 35 and not by a diameter of through openings 37, whose total cross sectional area is smaller than a total area of grooves 35 or groove 35'. Accordingly, a vacuum built up in grooves 35 by through openings 37 produces a significantly greater vacuum pressure than if outer circumference 33 were perforated with only through openings 37, i.e., if grooves 35 were eliminated.

External suction boxes 27 and 29 may be provided such that a vacuum present on their interiors may be primarily transmitted to an interior portion of web guide roll 11 or 13 so that material web 15 may be secured or fixed to portion of outer circumference 33 positioned opposite the suction box. Further, it may be advantageous to provide perforations in the lateral limiting walls of suction boxes 27 and 29, which are positioned in the vicinity of dryer cylinders 5, 7, and 9. Thus, a further vacuum force may be created or built up adjacent to the lateral limiting walls to also act upon material web 15 through transport belt 17 as it is guided between either the dryer cylinder and the adjacent web guide roll or the web guide roll and the adjacent dryer cylinder. Accordingly, material web 15 may be secured to transport belt 17 to additionally stabilize the web guidance.

The process of the present invention may be explained from the descriptions of FIGS. 1–5. The process may include forming through openings 37 into jacket 31, forming grooves 35 or groove 35' in outer circumference 33 such that the formed groove(s) may be coupled to through openings 37. Through openings 37 may be preferably positioned so that each through opening 37 is fed into the groove(s). Alternatively, through openings 37 may be formed through jacket 31 and adjacent the groove(s) along outer circumference 33.

As discussed above, grooves 35, which, e.g., may be continuous, may be formed to be arranged either on a closed circular line or on an imaginary helix extending along outer circumferential surface 33.

In accordance with the features of the present invention, through openings 37 and groove(s) 35, 35' may also be retroactively formed into the outer surface of jacket 31, even if the web guide roll remains installed in machine 1. Thus, in accordance with the present process, existing machines may be retroactively retooled to eliminate any need for internal suctioning of web guide rolls 11 and 13. The internal suctioning may be replaced with external suction boxes 27 and 29, which may be arranged so that material web 15 is secured to conveyor belt 17 by vacuum as they pass the suction box.

Because through openings 37 feed into grooves 35 or 35' from the interior of the web guide rolls, a favorable suction effect and a sufficient holding force may be produced and exerted on material web 15, even when there is a relatively low vacuum in the web guide rolls. The retooling of the web guide roll may occur in a more rapid manner if through openings 37 are combined with grooves 35 or 35', i.e., the number of through openings 37 may be reduced without eliminating a sufficient holding force. At the same time, jacket 31 of web guide rolls 11 and 13 is not unnecessarily weakened by the formation of through openings 37.

In the foregoing discussion of the present invention, it has been assumed that web guide rolls 11 and 13 may be utilized in connection with a single- or one-row dryer group, however, it is also contemplated that the present invention may also be utilized with two-row dryer groups or other regions of the web producing machine. Suction web guide rolls 11 and 13 of the type described herein, may be utilized wherever guided deflection of a material web is desired.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A machine for producing a material web comprising:

a dryer section including at least one dryer group having a plurality of dryer cylinders and a plurality of web guide rolls;

at least one of the plurality of web guide rolls including a jacket;

an external suction box;

the jacket including a plurality of through openings and at least one groove formed in an outer surface of the jacket; and a predetermined number of the plurality of through openings coupled to the at least one groove and associated with the external suction box.

2. The machine according to claim 1, the at least one groove comprising a plurality of grooves located over a width of the jacket.

3. The machine according to claim 2, each of the plurality of grooves being arranged on a closed circular line.

4. The machine according to claim 2, the plurality of grooves being equally spaced from each other.

5. The machine according to claim 1, the at least one groove extends in the form of a helix.

6. The machine according to claim 1, the at least one groove being continuous.

7. The machine according to claim 1, a total area of the at least one groove is substantially greater than a total cross sectional area of the predetermined number of through openings.

8. The machine according to claim 1, each of the at least one web guide rolls associated with a suction box.

9. A process for producing a material web in a web producing machine, the web producing machine including a dryer section including at least one dryer group having a plurality of dryer cylinders and a plurality of web guide rolls, at least one of the plurality of web guide rolls associated with an external suction box and including a jacket having a plurality of through openings and at least one groove formed in an outer surface of the jacket, the process comprising:

forming at least one groove in an outer surface of the jacket of the web guide roll;

forming through openings in the at least one groove; and associating an external suction box with the through openings formed in the at least one groove.

10. The process according to claim 9, further comprising:

forming a plurality of grooves in the outer surface of the jacket;

distributing each of the plurality of formed grooves over a width of the jacket; and arranging each of the plurality of formed grooves on a closed circular line.

11. The process according to claim 10, further comprising equally spacing each of the formed plurality of grooves.

12. The process according to claim 9, further comprising forming the at least one groove as a helix extending along the jacket.

13. The process according to claim 9, further comprising forming the at least one groove as at least one continuous groove.

14. The process according to claim 9, further comprising forming the through openings and the at least one groove in the jacket while the at least one web guide roll is mounted in the machine.

15. The process according to claim 9, the material web comprising one of paper and cardboard.

16. A suction web guide roll positioned in a dryer section of a material web producing machine comprising:

an elongated hollow jacket;

the elongated hollow jacket comprising a plurality of through holes;

at least one groove formed in an outer surface of the jacket, the groove comprising a bottom surface; and a predetermined number of the plurality of the through holes coupled to the bottom surface; and an external suction box positioned adjacent the outer surface of the jacket and in communication with the predetermined number of the plurality of through holes.

17. The suction web guide roll according to claim 16, the plurality of through holes comprising a plurality of substantially radial through holes.

18. The suction web guide roll according to claim 16, the at least one groove comprising a width greater than a diameter of each of the predetermined number of the through holes.

19. The suction web guide roll according to claim 16, the at least one groove comprising a plurality of circular grooves arranged substantially parallel to each other.

20. The suction web guide roll according to claim 19, the plurality of circular grooves arranged substantially perpendicular to a longitudinal axis of the web guide roll.

21. The suction web guide roll according to claim 16, the at least one groove comprising a helical groove extending a length of the jacket.

22. The suction web guide roll according to claim 16, the plurality of through openings further comprising through openings coupled to the outer surface of the jacket.

23. A process for forming a suction web guide roll comprising:

forming at least one groove, comprising a bottom surface, in an outer surface of an elongated jacket;

forming a plurality of through holes in the at least one groove; and positioning a suction box adjacent the at least one groove.

24. The process according to claim 23, forming the plurality of through holes comprising forming each of the plurality of through holes within the at least one groove, a diameter for each through hole being less than a width of the at least one groove.

25. The process according to claim 23, further comprising positioning an external suction device adjacent a portion of the jacket to suction an interior portion of the suction web guide roll.

26. The process according to claim 23, forming the at least one groove comprising forming a plurality of substantially parallel grooves in the ourter surface of the jacket.

27. The process according to claim 23, forming the at least one groove comprising forming a helical groove along a length of the jacket.

28. The process according to claim 23, further comprising performing the process on a web guide roll, comprising an air permeable material, seated in the machine.

29. The machine according to claim 1, the external suction box being positioned adjacent the outer surface of the jacket.

30. The process according to claim 9, further comprising:

positioning the external suction box along a portion of the outer surface of the jacket.

* * * * *